US008528949B2

(12) United States Patent
Katsumata et al.

(10) Patent No.: US 8,528,949 B2
(45) Date of Patent: Sep. 10, 2013

(54) DOOR HANDLE STROKE CHANGE STRUCTURE

(75) Inventors: Naoki Katsumata, Wako (JP); Daichi Okamoto, Wako (JP); Katsuya Ashizawa, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 445 days.

(21) Appl. No.: 12/897,791

(22) Filed: Oct. 5, 2010

(65) Prior Publication Data

US 2011/0101709 A1 May 5, 2011

(30) Foreign Application Priority Data

Nov. 2, 2009 (JP) ..... 2009-251621

(51) Int. Cl.
*E05C 3/06* (2006.01)

(52) U.S. Cl.
USPC ..... 292/201; 292/336.3

(58) Field of Classification Search
USPC ..... 292/201, 336.3
See application file for complete search history.

(56) References Cited

U.S. PATENT DOCUMENTS

| | | | | |
|---|---|---|---|---|
| 7,866,714 | B2 * | 1/2011 | Monig et al. | 292/336.3 |
| 2005/0199024 | A1 * | 9/2005 | Wirths | 70/237 |
| 2011/0101709 | A1 * | 5/2011 | Katsumata et al. | 292/201 |

FOREIGN PATENT DOCUMENTS

| | | |
|---|---|---|
| JP | 2007-169903 | 7/2007 |

* cited by examiner

*Primary Examiner* — Shane Bomar
*Assistant Examiner* — Mark Williams
(74) *Attorney, Agent, or Firm* — Ditthavong Mori & Steiner, P.C.

(57) ABSTRACT

A door handle stroke change structure includes a latch mechanism, an electric latch drive mechanism, a mechanical latch drive mechanism, and an operation member which operates the electric latch drive mechanism and the mechanical latch drive mechanism. The operation member is moveable among a closed position, a first position at which the electric latch drive mechanism is operated, and a second position at which the mechanical latch drive mechanism is operated. A motion to move the operation member from the closed position to the first position is a same motion as a motion to move the operation member from the closed position to the second position. A movement amount of the operation member from the closed position to the first position is greater than a movement amount of the operation member from the closed position to the second position by the motion.

16 Claims, 10 Drawing Sheets

DOOR HANDLE STROKE CHANGE STRUCTURE

CROSS REFERENCES TO RELATED APPLICATIONS

The present application claims priority under 35 U.S.C. §119 to Japanese Patent Application No. 2009-251621, filed on Nov. 2, 2009, entitled "Door Handle Stroke Change Structure." The contents of this application are incorporated herein by reference in their entirety.

BACKGROUND OF THE PRESENT INVENTION

1. Field of the Present Invention

The present invention relates to a door handle stroke change structure.

2. Description of the Related Art

In the related art, a door which opens or closes a door opening of a vehicle has a latch mechanism which engages with a door lock striker to maintain a state where the door closes the door opening and which releases the engagement with the door lock striker (hereinafter, referred to as "open action") by an open operation of a door handle (operation member).

Further, Japanese Unexamined Patent Application Publication No. 2007-169903 discloses a door which has two latch drive mechanisms for normal time and emergency, respectively, each causing one latch mechanism to perform an open action, and which has two operation members which operate the two latch drive mechanisms, respectively. Specifically, the door of this publication has an electric latch drive mechanism which causes the latch mechanism to perform the open action by a power source such as a motor at normal time, and also has a switch which activates the electric latch drive mechanism. In addition, for emergency when the latch mechanism cannot be electrically activated since a wiring breaks or a battery runs out, the door of this publication has a mechanical latch drive mechanism which mechanically causes the latch mechanism to perform the open action, and also has an operation member which drives the mechanical latch drive mechanism.

However, according to the door disclosed in the above publication, the operating manner of the operation member which operates the electric latch drive mechanism for normal time is different from that of the operation member which operates the mechanical latch drive mechanism for emergency. Thus, a user needs to understand and memorize the different operating manners of the two operation members, and is forced to bear heavy burden. In particular, in a door open operation at emergency, since the operation member for emergency is not usually used, even if the user understands the operating manner once, there is the possibility that the user will forget the operating manner for emergency when using this operation member. Therefore, the electric latch drive mechanism for normal time does not operate in the state where the occupant is in the vehicle, and hence the occupant becomes panic, so that the occupant cannot perform the door open operation for emergency and is trapped in the vehicle compartment.

SUMMARY OF THE INVENTION

According to one aspect of the present invention, a door handle stroke change structure includes a door, a latch mechanism, an electric latch drive mechanism, a mechanical latch drive mechanism, and an operation member. The door opens and closes a door opening of a vehicle. The latch mechanism causes the door to engage with the vehicle. The electric latch drive mechanism electrically causes the latch mechanism to perform an open action. The mechanical latch drive mechanism mechanically causes the latch mechanism to perform the open action. The operation member is provided in the door and operates the electric latch drive mechanism and the mechanical latch mechanism. The operation member is moveable among a closed position at which the latch mechanism is not caused to perform the open action, a first position at which the latch mechanism is caused to perform the open action by the electric latch drive mechanism, and a second position at which the latch mechanism is caused to perform the open action by the mechanical latch drive mechanism. A motion by a user to move the operation member from the closed position to the first position is a same motion as a motion by the user to move the operation member from the closed position to the second position are caused to be same. A movement amount of the motion by the user to move the operation member from the closed position to the first position is greater than a movement amount of the motion by the user to move the operation member from the closed position to the second position.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
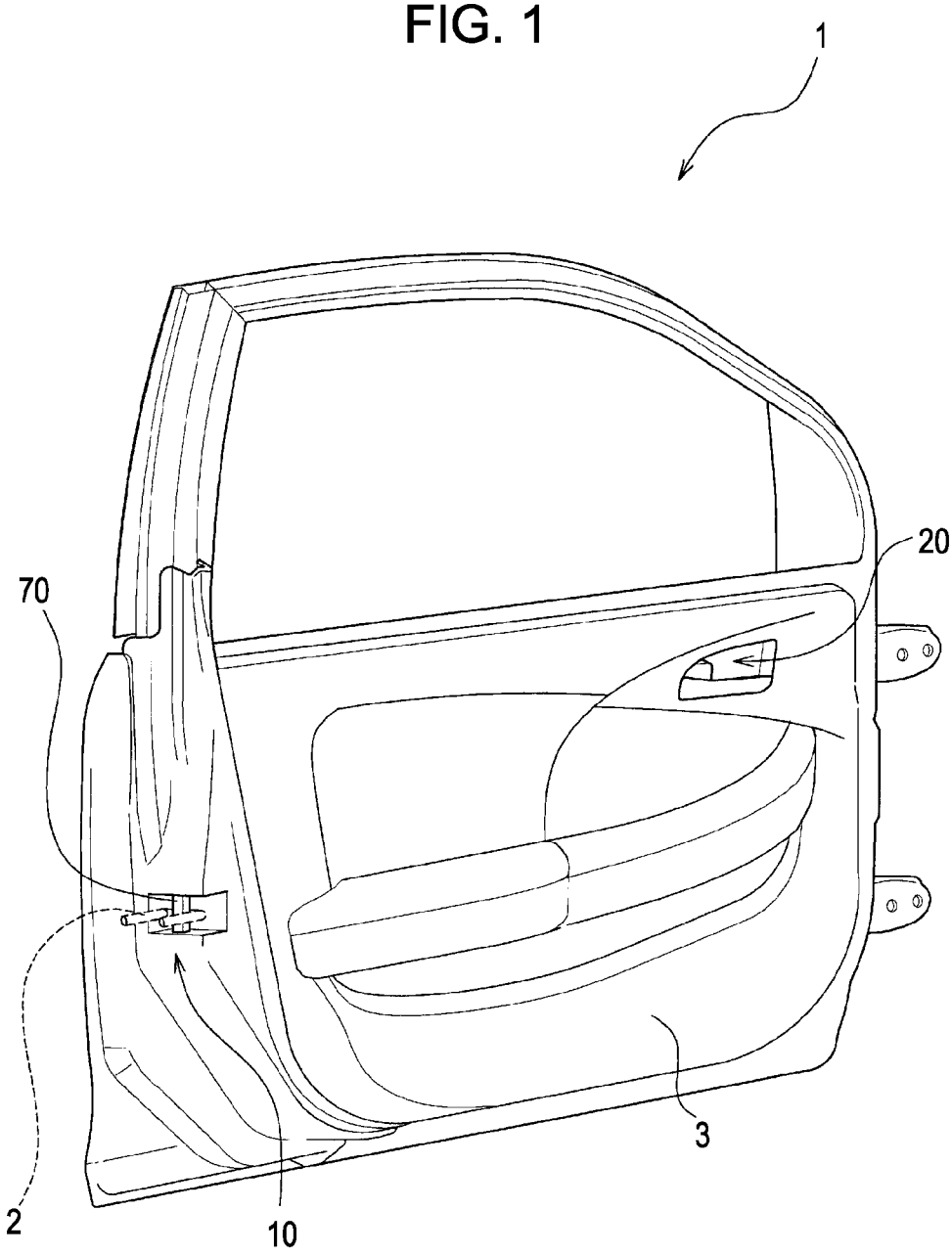
FIG. 1 is a perspective view of a door according to an embodiment when viewed from an upper side in a vehicle.

A handle stroke change structure according to an embodiment of the present invention will be described with reference to the accompanying drawings. Note that the same components are designated by the same reference numerals. A door 1 shown in FIG. 1 is the left front door of a vehicle. The door 1 serves to open or close a door opening which is formed such that an occupant can get on or off the vehicle therethrough, and is mounted to a vehicle body so as to freely open or close the door opening. As shown in FIG. 1, the door 1 includes: a door body 3 formed into a shape which fits to the door opening; and a door lock device 10 accommodated in the door body 3. In the present invention, the door body 3 is not particularly limited to any specific one, and thus the detail description thereof is omitted. The door body 3 has an accommodation space (not shown) for accommodating components of the door lock device 10 which will be described later.

(Door Lock Device 10)

As shown in FIG. 1, the door lock device 10 is accommodated in the door body 3 and engages with or disengages from a door lock striker 2 which projects from an edge surface of the door opening and has a U shape in a plan view. The door lock device 10 includes an operation portion 20, a latch mechanism 70, and a latch drive mechanism 80 (see FIG. 6). The following will describe in detail the operation portion 20, the latch mechanism 70, and the latch drive mechanism 80, which constitute the door lock device 10. Note that, in the embodiment, a description will be given such that, where the door 1, which is the left front door in the state of closing the door opening of the vehicle, is used as a reference, the front of the vehicle is replaced by front; the rear of the vehicle is replaced by rear; the vehicle outside which is the side surface side of the vehicle is replaced by a left side; and the vehicle inside is replaced by a right side; the roof side of the vehicle is replaced by an upper side; and the bottom side of the vehicle is replaced by a lower side.

(Operation Portion 20)

Figure 2:
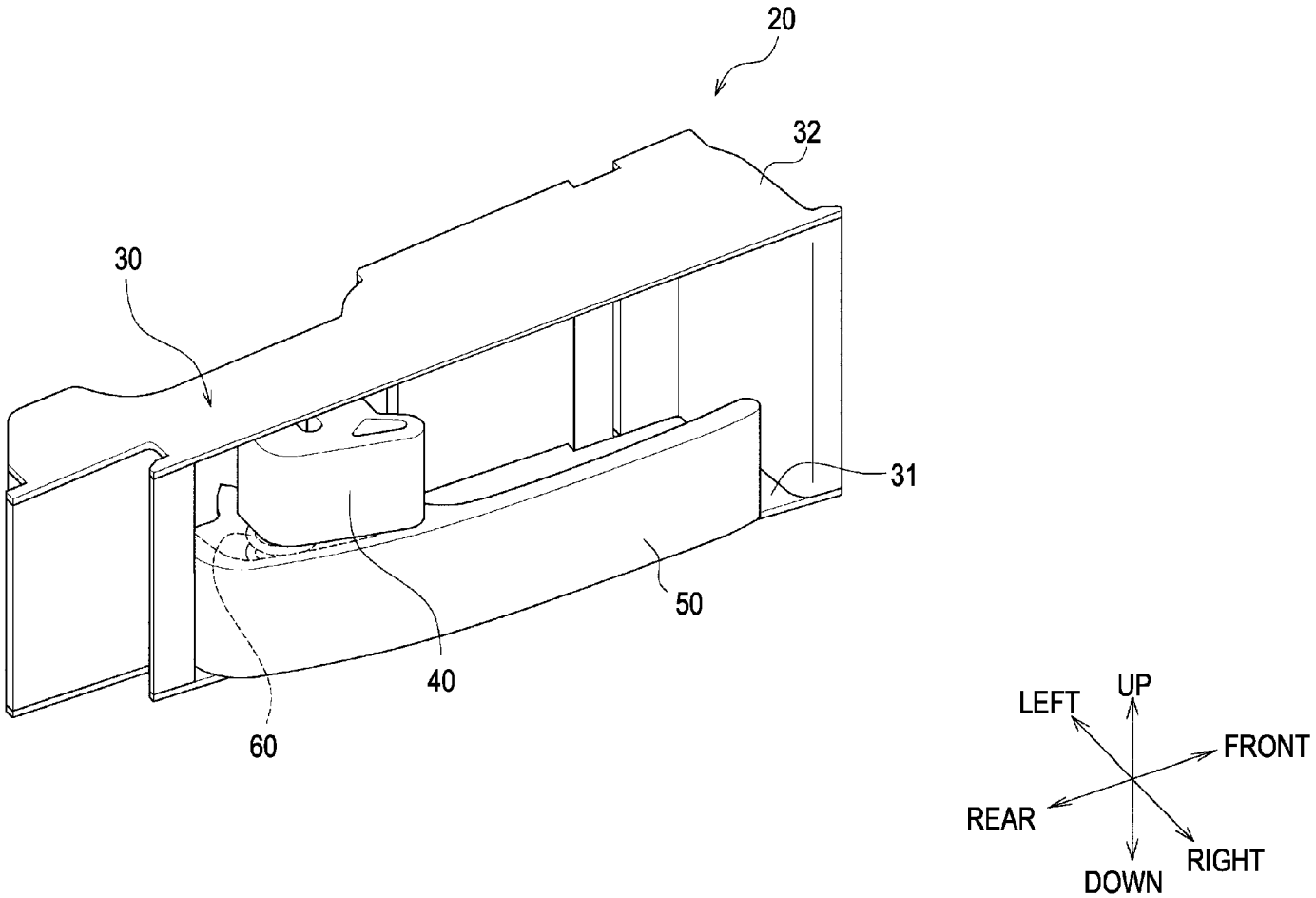
FIG. 2 is a view of an operation portion provided in the door according to the embodiment.

As shown in FIG. 1, the operation portion 20 is located so as to be exposed on the right side surface of the door body 3, which is the vehicle compartment side, in a state of being accommodated in the door body 3, and is provided so as to be able to be operated by the occupant in the vehicle compartment. As shown in FIG. 2, the operation portion 20 includes a case 30, a trigger button 40, a handle 50, and a spring 60.

(Case 30)

Figure 3:
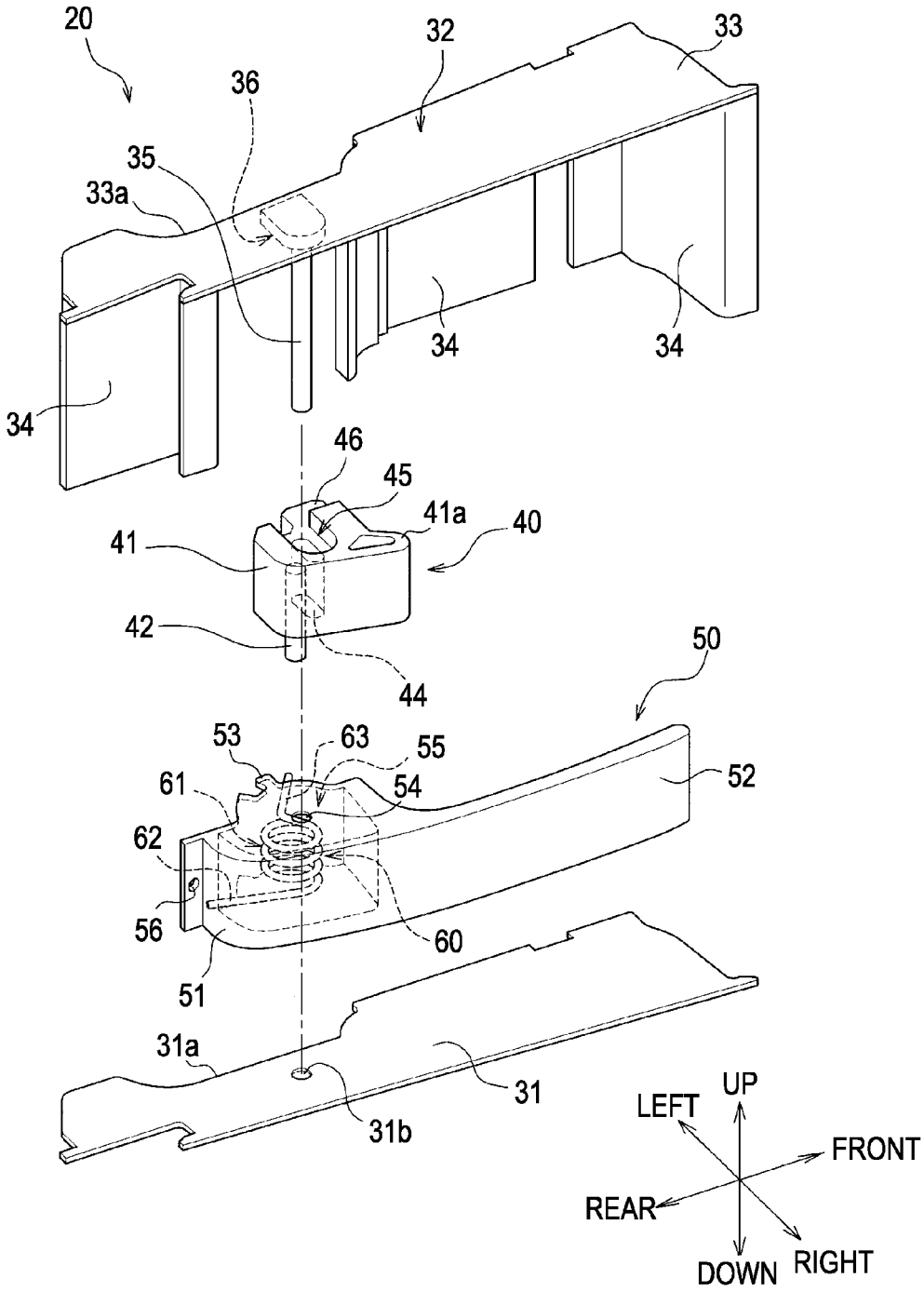
FIG. 3 is an exploded perspective view of the operation portion shown in FIG. 2 when viewed from the upper side in the vehicle.
Figure 4:
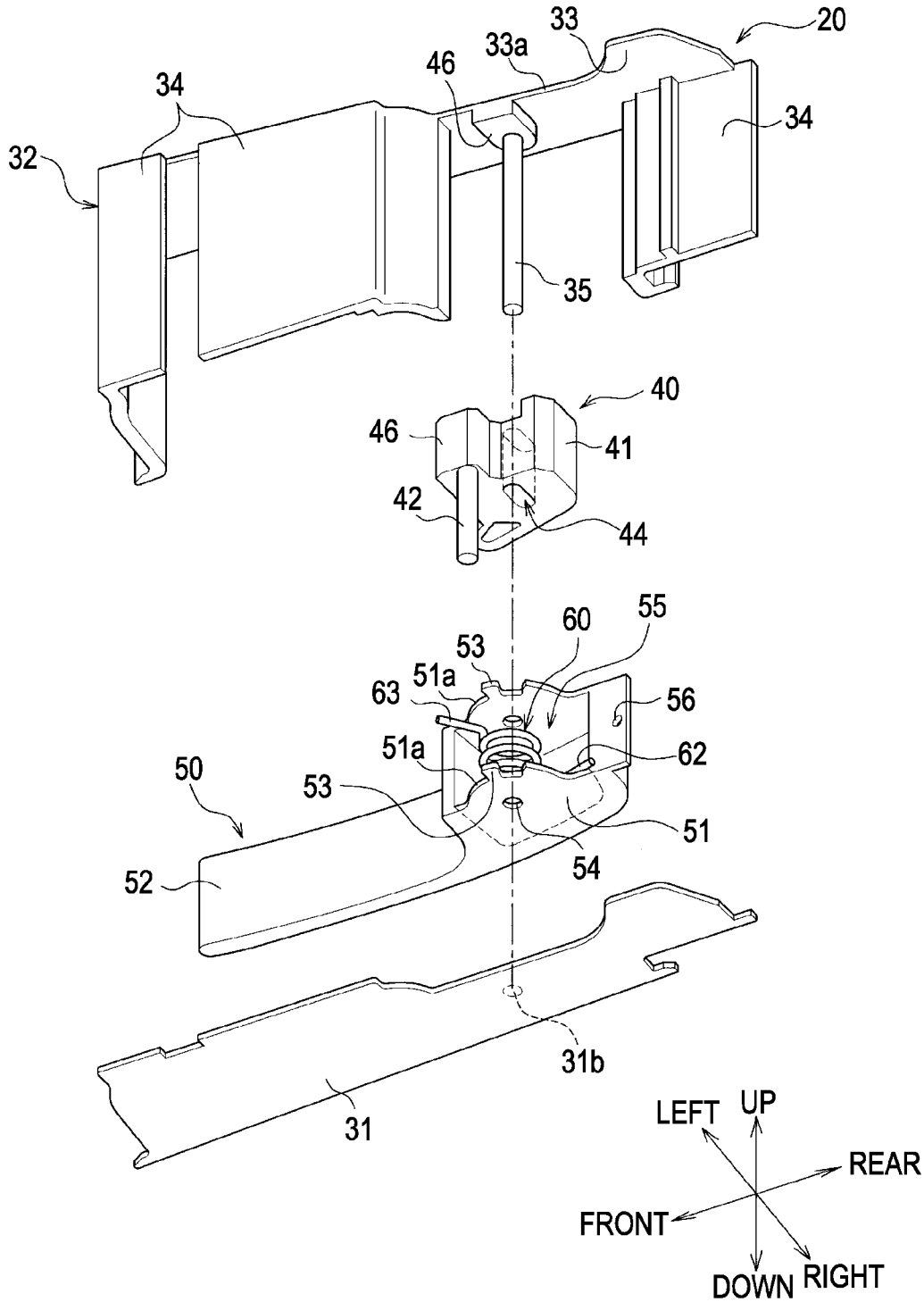
FIG. 4 is an exploded perspective view of the operation portion shown in FIG. 2 when viewed from a lower side of an outside surface of the vehicle.

As shown in FIG. 2, the case 30 accommodates the trigger button 40, the handle 50, and the spring 60. As shown in FIGS. 3 and 4, the case 30 is formed by combining: a case lower member 31, which forms a bottom of the case 30; and a case upper member 32 in which an upper surface 33 having the same shape as the case lower member 31 and a side wall surface 34 are integrally formed with each other.

As shown in FIGS. 3 and 4, the case 30 is a plate-like member which is formed so as to fit to a space (not shown), for accommodating the operation portion 20, which is formed in the door body 3. The case lower member 31 has a recess 31*a* which, in a plan view, is substantially linear at the front portion of the left edge thereof and is recessed at the rear portion of the left edge thereof toward the right side. In addition, as shown in FIG. 3, the case lower member 31 has a hole 31*b* on the rear side and near the recess 31*a*, into which hole 31*b* a later-described shaft 35 of the case upper member 32 can be fitted.

Figure 5:
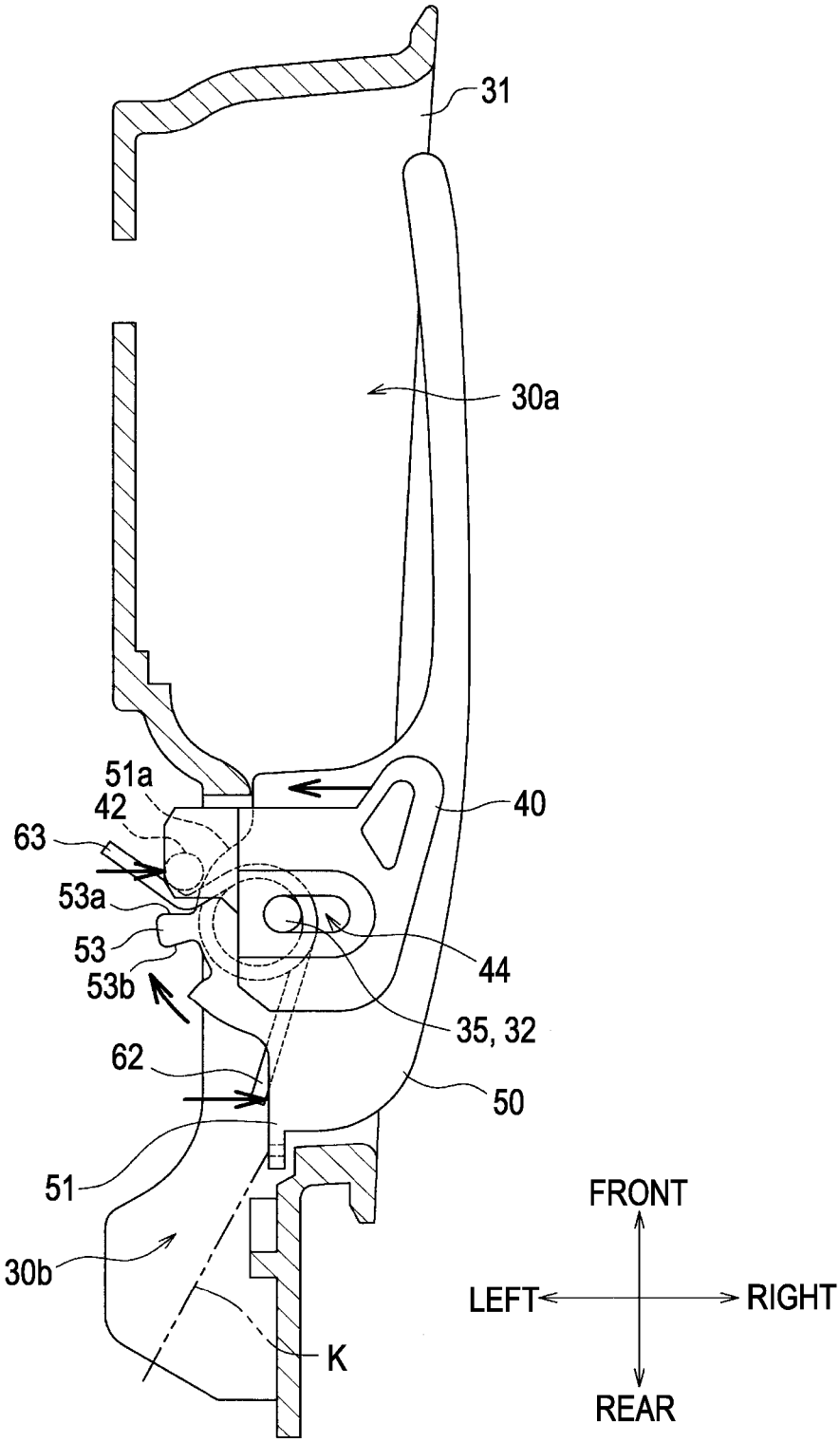
FIG. 5 is a plan view of the operation portion shown in FIG. 2 when viewed from an upper side thereof.

As shown in FIGS. 3 and 4, the case upper member 32 is formed by integrally forming: the upper surface 33 formed into the same shape as that of the case lower member 31; the side wall surface 34 extending downwardly from the edge of the upper surface 33; and the shaft 35 and a case projection 36 formed on the upper surface 33. The upper surface 33 is a plate-like portion formed into the same shape as that of the case lower member 31, and has a recess 33*a* which is substantially linear at the front portion of the left edge thereof and is recessed at the rear portion of the left edge thereof toward the right side. In addition, the side wall surface 34 is a portion which extends downwardly from the front edge, the front portion of the left edge, and the edge near the right rear corner between the right edge and the rear edge, of the upper surface 33. Thus, as shown in FIG. 5, when the case lower member 31 is combined with the case upper member 32, a space is defined, which can accommodate the trigger button 40, the spring 60, and the handle 50. Further, the case 30 has a vehicle-compartment-side opening 30*a* in the right side surface thereof and a door-body-side opening 30*b* in the rear portion of the left side surface thereof near the rear side. Thus, as shown in FIG. 5, the handle 50 accommodated in the case 30 can be pulled from the vehicle compartment, and also can be connected to a cable K which is connected to the later-described latch drive mechanism 80.

Moreover, as shown in FIGS. 3 and 4, the shaft 35 of the case upper member 32 is a columnar body extending downwardly from the bottom surface side of the upper surface 33. The shaft 35 is formed such that, when the case lower member 31 and the case upper member 32 are combined with each other, the shaft 35 is fitted into the hole 31*b* formed in the case lower member 31.

As shown in FIGS. 3 and 4, the case projection 36 projects downwardly from the bottom surface side of the upper surface 33. In addition, the case projection 36 extends from around the shaft 35 toward the left edge.

(Trigger Button 40)

The trigger button 40 is a restriction member which restricts a rotation amount of the later-described handle 50, and is provided on the upper side of a support portion 51 of the handle 50 as shown in FIG. 2. As shown in FIGS. 3 and 4, the trigger button 40 includes: a pressed portion 41 pivotally supported by the shaft 35 of the case upper member 32; and a locking portion 42 projecting from the pressed portion 41.

The pressed portion 41 is to be pressed by the occupant at emergency. As shown in FIG. 3, in order to be easily pressed by the occupant, the trigger button 40 is formed such that a right portion 41*a* thereof projects on the front side to cause an area pressed from the vehicle compartment side to be large. In addition, as shown in FIGS. 3 and 4, the pressed portion 41 has: an elongated hole 44 extending through the upper surface and the bottom surface of the pressed portion 41; a groove 45 formed on the upper surface of the pressed portion 41; and an extension 46 extending from the left side surface of the pressed portion 41.

Further, as shown in FIGS. 3 and 4, the elongated hole 44 is formed with such a size that the shaft 35 of the case upper member 32 can extend therethrough, and is elongated in the lateral direction of the pressed portion 41.

As shown in FIG. 3, the groove 45 is formed on the upper surface of the pressed portion 41 so as to extend in the lateral direction. In addition, the groove 45 is formed so as to fit to the case projection 36 formed near the shaft 35 of the case upper member 32 when the pressed portion 41 is pivotally supported by the shaft 35 of the case upper member 32 being inserted into the elongated hole 44 thereof. Moreover, the groove 45 is formed longer than the case projection 36 such that the trigger button 40 is moveable along the case projection 36 in the lateral direction.

The extension 46 extends from the left side surface of the pressed portion 41 and supports the later-described locking portion 42.

As shown in FIG. 4, the locking portion 42 is a columnar portion extending downwardly from the bottom surface side of the extension 46. In addition, the locking portion 42 extends downwardly to such an extent as to be able to be brought into contact with a trigger button locking portion 63 of the later-described spring 60 and a projection 53 of the handle 50.

The trigger button 40 is supported by the shaft 35 of the case upper member 32 being inserted into the elongated hole 44. In addition, as shown in FIG. 5, the case projection 36 of the case upper member 32 is inserted in the groove 45, and the trigger button 40 is supported so as to be moveable along the case projection 36 in the lateral direction.

(Handle 50)

The handle 50 is an operation member for the occupant to operate the later-described latch drive mechanism 80. In addition, the handle 50 is connected to the latch drive mechanism 80 via the cable K. As shown in FIGS. 3 and 4, the handle 50 is formed by integrally forming: the support portion 51 which has a hole 54 and is pivotally supported by the shaft 35 of the case upper member 32; a grip 52 formed on the right side of the support portion 51; and the projection 53 formed on the left side of the support portion 51.

The support portion 51 has: a left edge 51*a* which is formed into a semi-circular shape; the hole 54 in a center portion thereof; a spring accommodating portion 55 for accommodating a spring 60 therein; and a hooked portion 56 to which the cable K is hooked. The hole 54 is a hole in which the shaft 35 of the case upper member 32 is inserted. In addition, the hole 54 is formed in the center portion of the support portion 51 and at a position that is the center of the semi-circle of the left edge 51. As shown in FIG. 5, the distance from the left edge 51*a* to the hole 54 is set such that the left edge 51*a* of the support portion 51 does not contact the locking portion 42 of the trigger button 40 when the trigger button 40 moveable in the lateral direction is located in the rightmost position. Thus, when the shaft 35 of the case upper member 32 is inserted in the hole 54 of the support portion 51, even if the handle 50 is rotated as shown in FIG. 5, the left edge 51*a* of the support portion 51 does not interfere with the locking portion 42 of the trigger button 40.

The spring accommodating portion 55 is a space defined in the support portion 51, and has such a size that the spring 60 can be accommodated therein. The hooked portion 56 is a hole formed on the rear portion of the support portion 51 near the door-body-side opening 30*b* of the case 30, and the cable K connected to the later-described latch drive mechanism 80 is hooked thereto.

The grip 52 is a portion to be held by the occupant for releasing the door 1, and extends frontward from the right side wall of the support portion 51 as shown in FIGS. 3 and 4.

As shown in FIGS. 3 and 4, the projection 53 projects leftward from the semi-circular left edge 51*a* of the support portion 51. When the handle 50 is rotated about the shaft 35 from a closed position to a first position (see FIG. 7B), the projection 53 is formed at such a location as to be locked with the locking portion 42 of the trigger button 40. Note that the closed position and the first position of the handle 50 will be described later. In addition, as shown in FIG. 5, in the projection 53, one edge in the rotation direction of the handle 50 constitutes a locked portion 53*a*, and the other edge constitutes a second locked portion 53*b*.

As shown in FIG. 5, the handle 50 is rotationally mounted to the case 30 by the shaft 35 of the case upper member 32 being inserted into the hole 54 in the state where the spring 60 is accommodated in the spring accommodating portion 55. Note that the position of the handle 50 shown in FIG. 5 is referred to as the closed position, at which the handle 50 is not operated by the occupant, that is, at which the door 1 is locked by the door lock device 10. Further, if the handle 50 supported by the case 30 is rotated when the trigger button 40 is located on the right side, the locked portion 53*a* of the projection 53 is brought into contact with the locking portion 42 of the trigger button 40, thereby restricting the rotation of the handle 50. Note that the position of the handle 50 when the locked portion 53*a* of the projection 53 is brought into contact with the locking portion 42 of the trigger button 40 is the first position. Moreover, when the trigger button 40 is moved leftward (see FIG. 9A), the handle 50 can be rotated from the closed position past the first position without interference of the projection 53 of the handle 50 with the locking portion 42 of the trigger button 40 (see FIG. 9B). The position of the handle 50 which has been rotated past the first position is a second position.

(Spring 60)

As shown in FIGS. 3 and 4, the spring 60 is mounted to the shaft 35 of the case upper member 32 and serves to urge the trigger button 40 and the handle 50 in a predetermined direction. The spring 60 includes: a coiled center portion 61; a handle locking portion 62 extending from one end of the coil; and a trigger button locking portion 63 extending from the other end of the coil.

The diameter of the coiled center portion 61 is set such that the shaft 35 of the case upper member 32 can be inserted thereinto. As shown in FIG. 5, the handle locking portion 62 is locked with the support portion 51 of the handle 50 when the shaft 35 of the case upper member 32 is inserted in the center portion 61 of the spring 60. As shown in FIG. 5, the trigger button locking portion 63 is locked with the locking portion 42 of the trigger button 40 when the shaft 35 of the case upper member 32 is inserted in the center portion 61 of the spring 60.

As shown in FIGS. 3 and 4, the spring 60 is mounted to the case 30 by the shaft 35 of the case upper member 32 being inserted into the hole 54 of the handle 50 in the sate where the spring 60 is accommodated in the spring accommodating portion 55 of the handle 50. Further, as shown in FIG. 5, the spring 60 urges the trigger button 40 such that the trigger button locking portion 63 moves the trigger button 40 rightward, and also urges the handle 50 such that the handle locking portion 62 moves the handle 50 toward the closed position.

The components of the operation portion 20 have been described above. Note that, of the components of the operation portion 20, the projection 53 provided in the rotated handle 50, and the locking portion 42 of the trigger button 40 which is locked with the projection 53, correspond to a "restriction mechanism" recited in the appended claims. Further, the elongated hole 44 of the trigger button 40 for moving the trigger button 40 leftward to release the locking of the projection 53 of the handle 50 with the locking portion 42 of the trigger button 40, corresponds to a "release mechanism" recited in the appended claims.

(Latch Mechanism 70)

Figure 6:
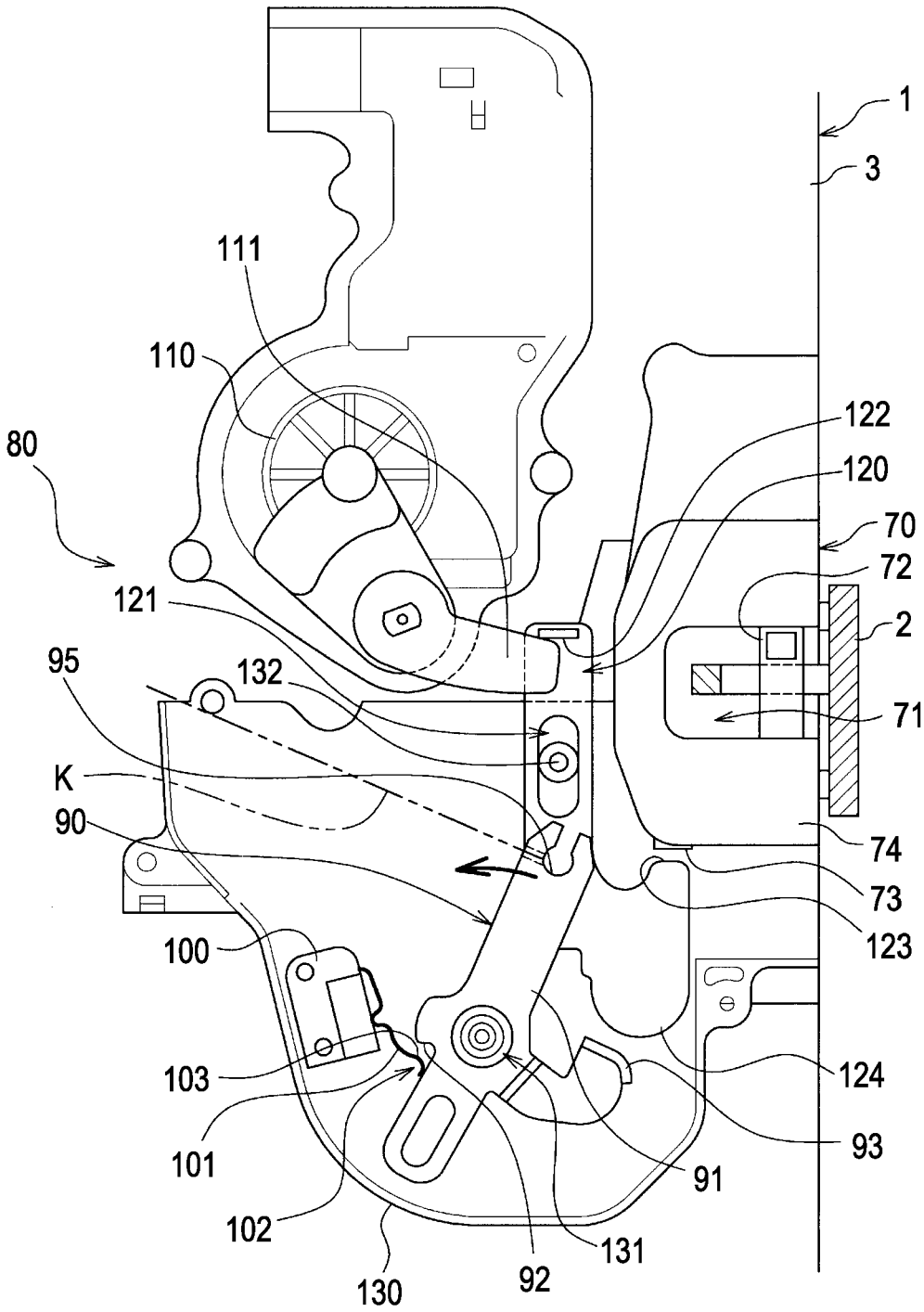
FIG. 6 is a side view showing a partial cross section of a latch drive mechanism and a latch mechanism accommodated in a door body.

As shown in FIG. 6, the latch mechanism 70 is located in the door body 3 and near a center pillar (not shown), and engages with or disengages from the door lock striker 2 provided in the center pillar. In addition, the latch mechanism 70 includes: an accommodating portion 71 for accommodating the door lock striker 2; an engagement portion 72 which is provided so as to be moveable in the vertical direction in the accommodating portion 71 and so as to be inclinable toward the lower surface side of the accommodating portion 71; and a latch body 74 which urges the engagement portion 72 such that the engagement portion 72 always engages with the door lock striker 2. The latch body 74 has a switch portion 73 which, when pressed, lowers the engagement portion 72 to disengage from the door lock striker 2.

(Latch Drive Mechanism 80)

As shown in FIG. 6, the latch drive mechanism 80 is located in the door body 3 and near the latch mechanism 70, and serves to press the switch portion 73 of the latch mechanism 70. In addition, the latch drive mechanism 80 includes: a first rotation lever 90; a switch device 100 having a blade spring 101; a motor 110 having a second rotation lever 111; a connection lever 120; and a cover member 130.

(First Rotation Lever 90)

The first rotation lever 90 is connected to the cable K mounted to the handle 50, and is rotated in conjunction with rotation of the handle 50. The first rotation lever 90 has, in a center portion thereof, a hole (not shown) in which a shaft 131 of the cover member 130 is inserted. Thus, the first rotation lever 90 is rotationally supported by the shaft 131 so as to be inclined in the forward direction of the vehicle (in the direction of the arrow shown in FIG. 6). In addition, the first rotation lever 90 includes a body 91, a switch pressing portion 92, and a connection lever pressing portion 93, which extend in different directions, respectively, from the rotation axis of the first rotation lever 90.

The body 91 has, at an end thereof, a groove 95 to which the cable K is mounted. When the first rotation lever 90 is inclined in the forward direction of the vehicle according to the movement amount of the handle 50 moving from the closed position to the first position, the switch pressing portion 92 presses another end of the later-described blade spring 101. The connection lever pressing portion 93 is formed behind the switch pressing portion 92. When the first rotation lever 90 is inclined in the forward direction of the vehicle according to the movement amount of the handle 50 moving from the closed position to the second position, the connection lever pressing portion 93 presses an extension 124 of the later-described connection lever 120 upward. Further, the interval between the connection lever pressing portion 93 and the extension 124 is larger than that between the switch pressing portion 92 and the blade spring 101.

(Switch Device 100)

The switch device 100 has a drive button (not shown) for driving the later-described motor 110, and the blade spring 101. When the drive button is pressed, a voltage is applied from a battery (not shown) to the motor 110 to drive the motor 110. As shown in FIG. 6, the blade spring 101 has a substantially V shape. The blade spring 101 is mounted at one end of the substantially V shape thereof to the switch device 100 such that the top of the center portion of the substantially V shape thereof is brought into contact with the drive button. Further, the blade spring 101 extends, at the other end of the substantially V shape thereof, to a trajectory on which the switch pressing portion 92 of the first rotation lever 90 is rotated, and has a curved portion 102 which is formed at the other end thereof and which is pressed by the rotated switch pressing portion 92. The curved portion 102 is curved so as to be convexed toward the switch pressing portion 92. Note that the top of the convex of the curved portion 102 is referred to as a curved portion top 103. According to the above structure, when the first rotation lever 90 is rotated, the switch pressing portion 92 presses the curved portion 102 of the blade spring 101, causing the center portion of the blade spring 101 to press the drive button of the switch device 100.

(Motor 110)

The motor 110 is a drive member which rotates by a voltage being applied from the battery (not shown) thereto, and has a rotation shaft to which the second rotation lever 111 is mounted. The second rotation lever 111 has a substantially V shape and transmits the driving force of the rotation shaft of the motor 110 to the connection lever 120. The second rotation lever 111 is mounted at one end thereof to the rotation shaft of the motor 110, and is brought at the other end thereof into contact with a locking portion 122 of the later-described connection lever 120.

(Connection Lever 120)

The connection lever 120 has a substantially J shape. The connection lever 120 has: an elongated hole 121 formed in a center portion thereof along the vertical direction; the locking portion 122, at one end thereof, with which the second rotation lever 111 is brought into contact; a projection 123, at the other end thereof, which presses the switch portion 73 of the latch mechanism 70; and the extension 124 which is located on the lower side of the projection 123 and with which the first rotation lever 90 is brought into contact. The connection lever 120 is mounted so as to be moveable in the vertical direction, by a shaft 132, which extends in the lateral direction of the cover member 130, being inserted into the elongated hole 121. The connection lever 120 is provided at such a location that the first rotation lever 90 and the second rotation lever 111 can be brought into contact therewith, and that the connection lever 120 is moved upward by rotation of the first rotation lever 90 or the second rotation lever 111 to cause the projection 123 to press the switch portion 73 of the latch mechanism 70. Note that, in order to release the pressing of the switch portion 73, the connection lever 120 has an urging member (not shown) which moves the connection lever 120 downward when the connection lever 120 is not pressed by the first rotation lever 90 or the second rotation lever 111.

(Cover Member 130)

The cover member 130 accommodates the latch drive mechanism 80 other than the motor 110, and includes: the shaft 131 which pivotally supports the first rotation lever 90; and the shaft 132 which pivotally supports the connection lever 120.

The components of the latch drive mechanism 80 have been described above. Note that, of the components of the latch drive mechanism 80, the first rotation lever 90, the switch device 100, the motor 120 having the second rotation lever 111, and the connection lever 130, correspond to an "electric latch drive mechanism" recited in the appended claims. Further, the first rotation lever 90 and the connection lever 130 correspond to a "mechanical latch drive mechanism" recited in the appended claims.

(Usage)

The following will describe the usage of the handle stroke change structure according to the embodiment. The usage will be described separately for closed time, for normal time, and for emergency. In addition, a release state maintaining mechanism for emergency will be also described.

(Closed Time)

Figure 7A:
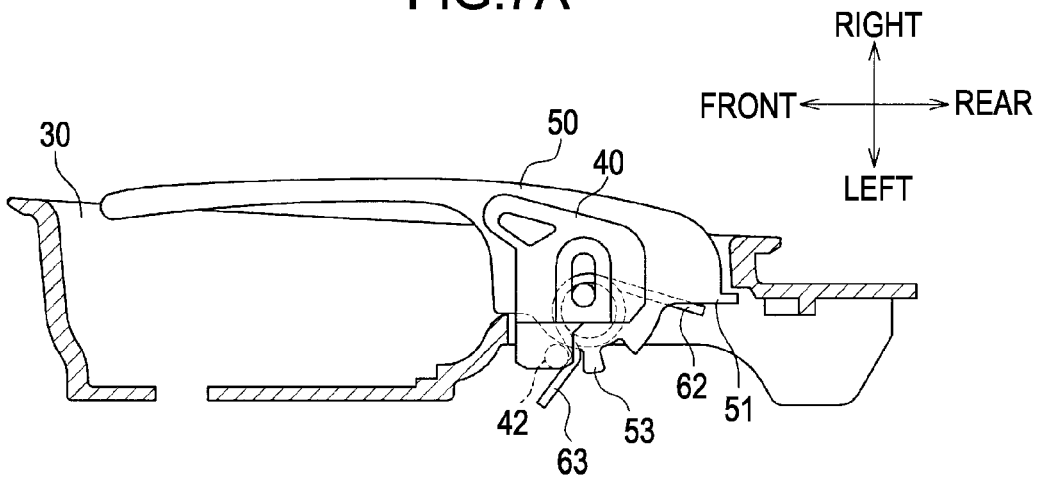
FIGS. 7A and 7B are plan views for illustrating usage of the operation portion at normal time.

Prior to operation, as shown in FIG. 7A, the handle 50 is located at the closed position. In other words, the handle locking portion 62 of the spring 60 is locked with the support portion 51 of the handle 50 and urges the support portion 51 so as to move the handle 50 to the closed position. Further, the trigger button locking portion 63 of the spring 60 at the other end is locked with the locking portion 42 of the trigger button 40 and urges the locking portion 42 so as to move the trigger button 40 rightward.

(Normal Time)

Figure 7B:
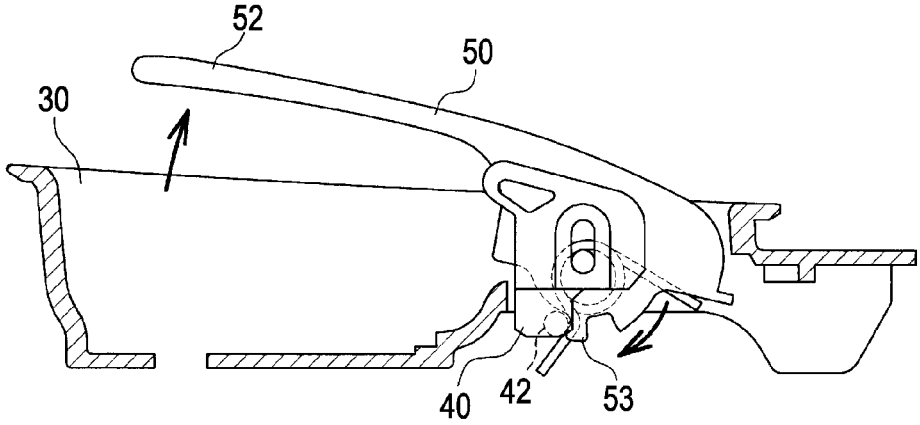

In an open operation at normal time, as shown in FIG. 7B, the grip 52 of the handle 50, which is an operation member, is pulled toward the vehicle compartment side. By so doing, the handle 50, which is rotationally supported by the case 30, is rotated in the direction toward the vehicle compartment side. In addition, in the rotated handle 50, the locked portion 53*a* of the projection 53 is brought into contact with the locking portion 42 of the trigger button 40, whereby the rotation of the handle 50 is restricted and the handle 50 stops at the first position.

Figure 8:
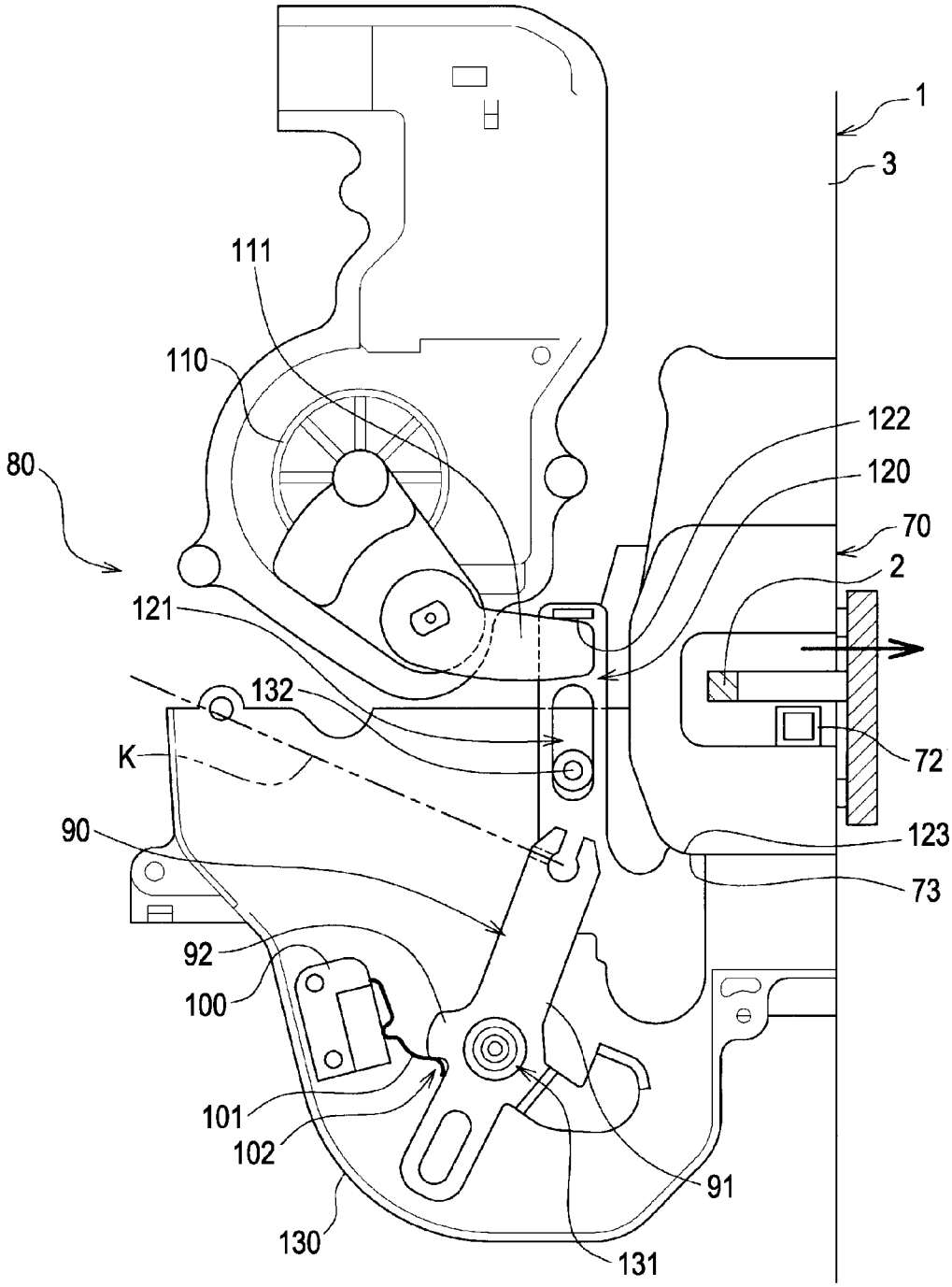
FIG. 8 is a side view for illustrating actions of the latch mechanism and the latch drive mechanism at normal time.

Then, as shown in FIG. 8, the first rotation lever 90, which is connected to the handle 50 via the cable K, is rotated according to a stroke amount of the handle 50 from the closed position to the first position. The switch pressing portion 92 of the first rotation lever 90 presses the curved portion 102 of the blade spring 101, causing the center portion of the blade spring 101 to press the drive button (not shown) of the switch device 100. Then, the switch device 100 applies a predetermined voltage from the battery (not shown) to the motor 110 to rotate the rotation shaft of the motor 110. Note that, at that time, the connection lever pressing portion 93 of the first rotation lever 90 is not brought into contact with the connection lever 124.

The second rotation lever 111, which is mounted to the rotation shaft of the motor 110, is rotated so as to raise the locking portion 122 of the connection lever 120. Then, by the connection lever 120 being raised, the projection 123 presses the switch portion 73 of the latch mechanism 70. Thus, the latch mechanism 70 whose switch portion 73 has been pressed moves the engagement portion 72 downward, such that the engagement portion 72 disengages from the door lock striker 2. Then, by pushing the door 1 toward the vehicle outside, the door opening can be opened.

(Emergency)

Figure 9A:
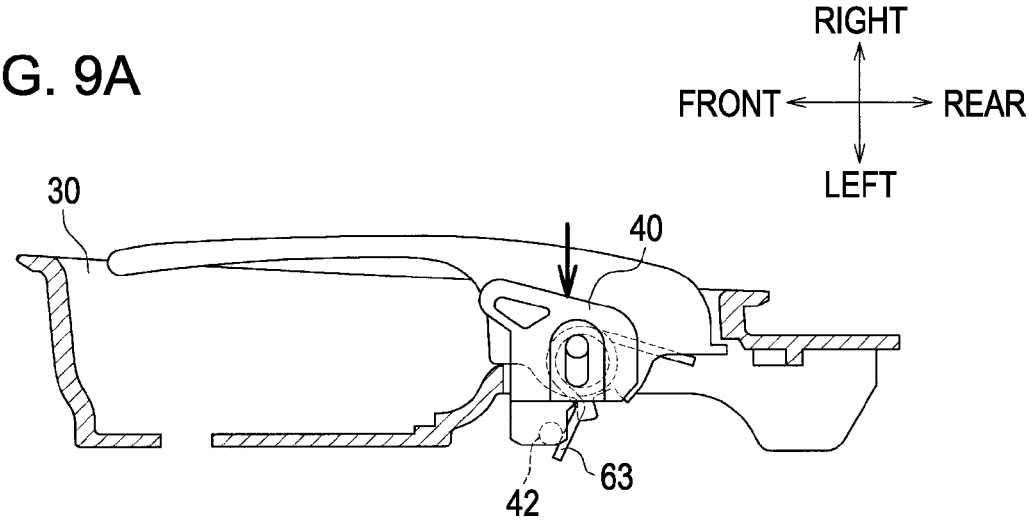
FIGS. 9A to 9C are plan views for illustrating usage of the operation portion at emergency.

At emergency, for example, when the battery runs out, the occupant presses leftward the trigger button 40, which is urged rightward by the trigger button locking portion 63 of the spring 60. By so doing, the trigger button 40 is moved against the urging force of the spring 60 as shown in FIG. 9A, and hence the locking portion 42 of the trigger button 40 is not located on the trajectory, on which the projection 53 of the handle 50 is rotated, and is not brought into contact with the projection 53. Thus, the occupant can move the handle 50 to the second position.

Figure 9B:
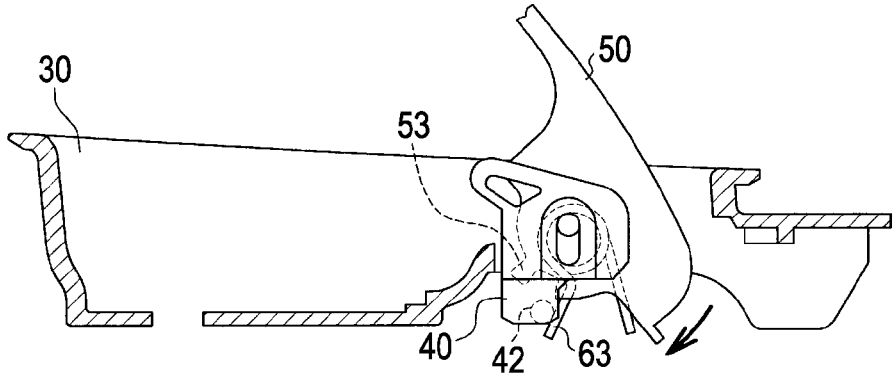

Then, while pressing the trigger button 40 leftward, the occupant pulls the handle 50 from the closed position to the second position as shown in FIG. 9B. By so doing, the first rotation lever 90, which is connected to the handle 50 via the cable K, is rotated according to the rotation amount of the handle 50 from the closed position to the second position as shown in FIG. 10.

The rotation amount of the handle 50 from the closed position to the second position is greater than the rotation amount of the handle 50 from the closed position to the first position. Thus, as shown in FIG. 10, the first rotation lever 90 is rotated by an amount greater than that at normal time. Then, the connection lever pressing portion 93 of the first rotation lever 90 is brought into contact with the lower portion of the extension 124 of the connection lever 120, raising the connection lever 120. By the connection lever 120 being moved upward, the projection 123 presses the switch portion 73 of the latch mechanism 70.

By so doing, the latch mechanism 70 whose switch portion 73 has been pressed moves the engagement portion 72 downward such that the engagement portion 72 disengages from the door lock striker 2. Then, by pushing the door 1 toward the vehicle outside, the door opening can be opened.

Figure 10:
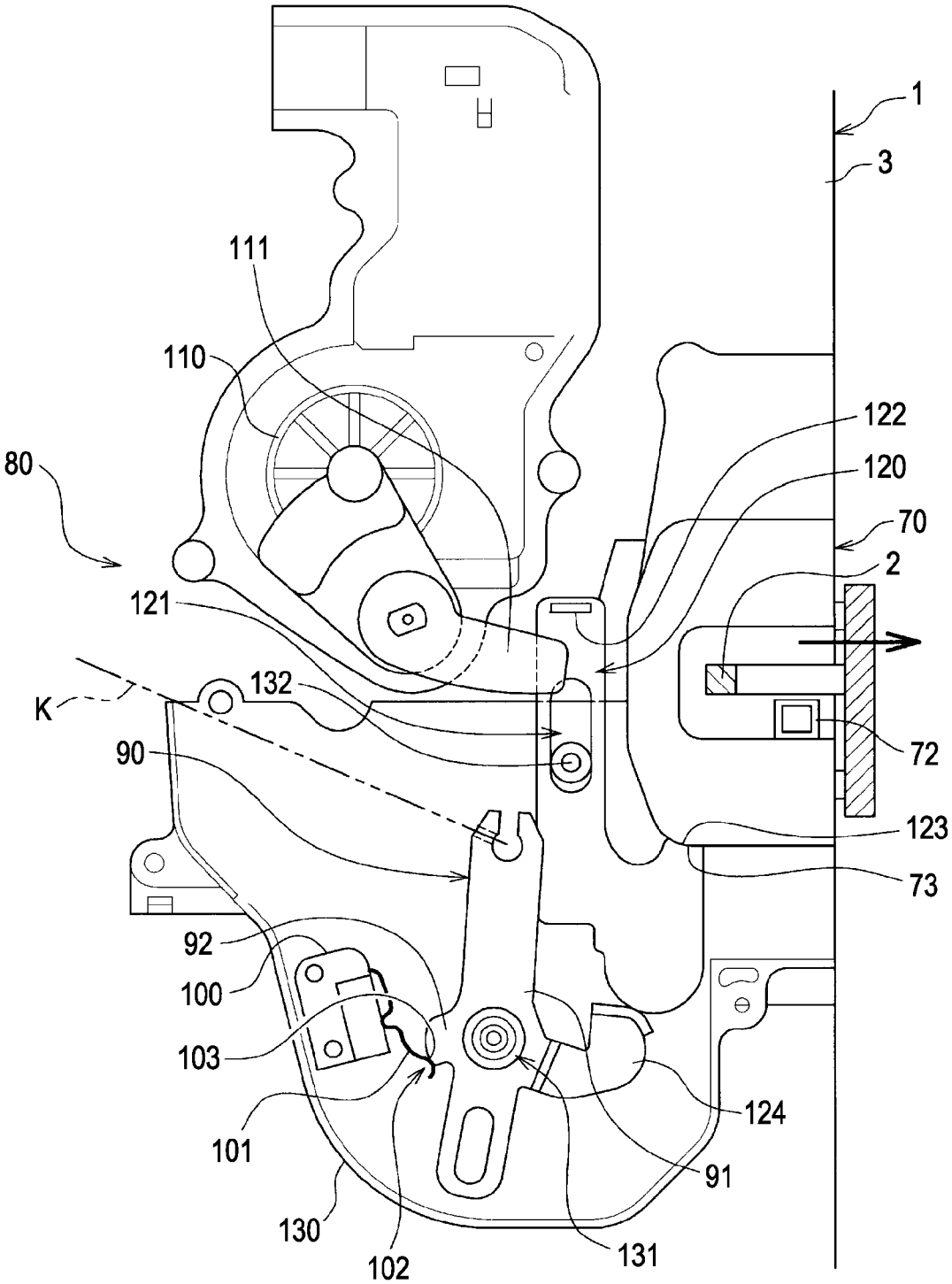
FIG. 10 is a side view for illustrating actions of the latch mechanism and the latch drive mechanism at emergency.

In addition, at emergency, as shown in FIG. 10, the first rotation lever 90 is rotated by an amount greater than that at normal time, and hence the switch pressing portion 92 is also displaced more greatly than at normal time. Here, the curved portion 102 of the blade spring 101, which is pressed by the switch pressing portion 92, is convexly curved. In other words, even if the switch pressing portion 92 is displaced more greatly than at normal time, the switch pressing portion 92 contacts the curved portion 102 so as to slide thereon over the curved portion top 103 toward the other end of the blade spring 101. Thus, an excessive force is not applied to the curved portion 102. Therefore, even if the switch pressing portion 92 is displaced more greatly than at normal time by the rotation of the first rotation lever 90 at emergency, the blade spring 101 is not excessively pressed, and hence the switch device 100 can be prevented from being damaged.

(Release State Maintaining Mechanism)

Figure 9C:
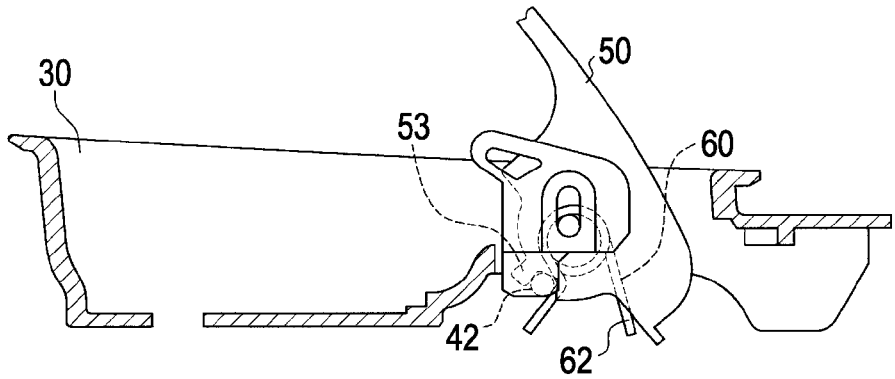

When a state where the door 1 is released is desired to be maintained, the pressing of the trigger button 40 is released in the state where the handle 50 is held at the second position as shown in FIG. 9B. In this case, as shown in FIG. 9C, the trigger button 40 is urged by the trigger button locking portion 63 of the spring 60 so as to be moved rightward. Thus, when the handle 50 is about to be rotated from the second position back to the closed position by the handle locking portion 62 of the spring 60, the second locked portion 53*b* of the projection 53 is brought into contact with the locking portion 42 of the trigger button 40 so as to be locked therewith, and hence the handle 50 is not returned to the closed position and the state where the handle 50 is located at the second position can be maintained. Therefore, as shown in FIG. 10, the state where the first rotation lever 90 has been rotated in conjunction with the handle 50 located at the second position is maintained, so that the first rotation lever 90 continues to press the switch portion 73 of the latch mechanism 70 and the latch mechanism 70 is maintained in a release state.

As described above, according to the door stroke change mechanism of the embodiment, the operation member operated in the open operation at normal time, and the operation member operated in an open operation at emergency, are the handle 50 which is a common operation member. In addition, the operating manners of the handle 50 at normal time and at emergency are different from each other in the rotation amount to the first position or the second position, but basically involve the same motion of pulling the grip 52 of the handle 50 toward the vehicle compartment side. Thus, the operation member for normal time and emergency is the handle 50 operated in the same manner, and hence a user can reduce the burden to memorize the operating manners for normal time and for emergency. Further, since the operating manners are the same, it is less likely to forget the door open operation for emergency and the possibility of being trapped in the vehicle is reduced.

Moreover, the shaft 35 of the case 30, which rotationally supports the handle 50 in the case 30, is an existing component which rotationally supports the handle 50. The trigger button 40 of the embodiment is pivotally supported by the shaft 35 of the case 30. Thus, the number of parts is reduced when compared to that in the case where a shaft 35 for pivotally supporting the trigger button 40 is separately provided.

Moreover, the handle locking portion 62, which is located at the one end of the spring 60, is locked with the handle 50 in order to return the rotated handle 50 to the closed position. However, in the embodiment, the trigger button locking portion 63, which is located at the other end of the spring 60, is locked with the trigger button 40. Thus, the number of parts is not particularly increased.

Moreover, the locking portion 42, which is formed in the trigger button 40, restricts the rotation amount of the handle 50 to the amount from the closed position to the first position, and restricts the handle 50 which has been rotated to the second position from returning to the closed position. Thus, according to the trigger button 40 of the embodiment, the one projection 53 has the functions of two restrictive members (the first locked portion 53*a* and the second locked portion 53*b*). Therefore, the structure can be simplified and the number of parts can be reduced.

The door stroke change mechanism has been described above, but the present invention is not limited thereto. For example, the locking portion 42 of the trigger button 40 may have a fragile portion. The fragile portion allows the locking portion 42 to be broken when a great force is applied thereto. Examples of the fragile portion include a notch along the rotation direction of the locking portion 42. According to this, when an occupant, who fails to open the door 1 by the operating manner for normal time, strongly pulls the handle 50 toward the vehicle compartment side, the projection 53 of the handle 50 can be brought into contact with the locking portion 42 of the trigger button 40 to break the locking portion 42. Then, the handle 50 can be moved to the second position, and it is possible to open the door 1.

According to the door handle stroke change structure of the embodiment of the present invention, it is possible to operate the electric latch drive mechanism and the mechanical latch drive mechanism, by operating the common operation member. The operating manner of moving the operation member from the closed position, at which the latch mechanism is not caused to perform the open action, to the first position, at which the latch mechanism is caused to perform the open action by the electric latch drive mechanism, and the operating manner of moving the operation member from the close position to the second position at which the latch mechanism is caused to perform the open action by the mechanical latch drive mechanism, are the same. Thus, by changing a movement amount of the operation member which operates the electric latch drive mechanism and the mechanical latch drive mechanism, namely, a stroke of the operation member, the electric latch drive mechanism and the mechanical latch drive mechanism can be operated with the operation member and by the same operating manner. Therefore, the user easily understands and memorizes the operating manner of the operation member, and user's burden can be reduced. In addition, the possibility of forgetting the operating manner before use can be reduced, and the user can be prevented from being trapped in the vehicle compartment due to the operating manner for emergency being forgotten.

Since the common operation member which operates the electric latch drive mechanism and the mechanical latch drive mechanism can be provided, the number of parts can be reduced. In addition, the operating manner of the operation member at emergency is moving the operation member from the closed position to the second position, the amount of which moving is greater than the movement amount of the operation member from the closed position to the first position at normal time. Thus, at normal time, the latch mechanism is caused to perform the open action with a small movement amount of the operation member, and hence the user can release the door with a small force. On the other hand, at emergency, there is a high possibility that the operation member will be strongly operated due to panic. By being strongly operated, the operation member can be moved to the second position, causing the latch mechanism to perform the open action. Thus, it is possible to reduce the possibility of being trapped in the vehicle compartment.

In the door handle stroke change structure of the embodiment of the present invention, a restriction mechanism which restricts a movement of the operation member from the first position to the second position may be provided, and the restriction mechanism may include a release mechanism which releases restriction of the movement of the operation member from the first position to the second position.

Since the door handle stroke change structure of the second aspect has the restriction mechanism which restricts the movement of the operation member from the first position to the second position, the user can be prevented from accidentally moving the operation member to the second position at normal time. Meanwhile, by providing the release mechanism which releases the restriction mechanism, the user can move the operation member to the second position only at emergency, and can urgently release the door.

In the door handle stroke change structure of the embodiment of the present invention, a restriction member which restricts the movement of the operation member from the first position to the second position may be provided; the operation member may be a handle which rotates about a rotation shaft provided in the door; the restriction mechanism may include a locking portion provided in the restriction member, and a locked portion which is provided in the handle and locked with a locking portion provided in the restriction member, in a rotation direction of the handle; the release mechanism may include the restriction member which has the locking portion and an elongated hole in which the rotation shaft is inserted; the restriction member may be locked with the locked portion of the handle when the rotation shaft is located at one end of the elongated hole in a longitudinal direction thereof; and locking with the locked portion of the handle may be released when the rotation shaft is located at the other end of the elongated hole in the longitudinal direction thereof.

According to the door stroke change structure of the embodiment of the present invention, since the restriction member slides using, as a guide, the rotation shaft of the handle through the elongated hole formed in the restriction member, the restriction mechanism and the release mechanism can be simplified and the number of parts can be reduced.

In the door handle stroke change structure of the embodiment of the present invention, the handle may be urged by an urging member so as to return to the closed position, and the restriction member may be urged by the urging member so as to return to a position at which the locking portion of the restriction member is locked with the locked portion of the handle.

According to the door stroke change structure of the embodiment of the present invention, by using the urging member which urges the handle such that the handle returns to the closed position, the restriction member is returned to the position at which the locking portion of the restriction member is locked with the locked portion of the handle. Thus, the number of parts can be reduced when compared to that in the case where an urging member is separately provided.

The door handle stroke change structure of the embodiment of the present invention may further include a release state maintaining mechanism which is able to hold the operation member at the second position.

According to the door stroke change structure of the embodiment of the present invention, even when the user does not hold the operation member at the second position, the operation member can be held at the second position by the release state maintaining mechanism. Thus, even when the user accidentally closes the door, the door can be opened again without moving the operation member to the second position.

In particular, the door stroke change structure of the fifth aspect may be applied to only an inner handle of the door, and the occupant may close the door after getting off the vehicle. In such a case, when opening the door, the occupant has to use a door release mechanism for emergency which is located outside the vehicle and different from the door handle stroke change structure. This operation takes time and effort. Thus, in such a case, by the release state maintaining mechanism, the operation member can be maintained at a state of releasing the door, and time and effort for using the door release mechanism for emergency from outside the vehicle, can be avoided.

In the door handle stroke change structure of the embodiment of the present invention, the handle may have a projection which projects in a radial direction of the rotation shaft; the locked portion may be provided at one end of the projection in a rotation shaft direction of the handle; the second locked portion which is able to be locked with the locking portion of the restriction member may be provided at the other end of the projection in the rotation shaft direction of the handle; and the second locked portion may be locked with the locking portion of the restriction member when the handle is located at the second position.

According to the door stroke change structure of the embodiment of the present invention, since the locking portion of the restriction member is locked with the second locked portion provided in the handle, the handle can be held at the second position.

Further, the door handle stroke change structure of the sixth aspect may be applied to only an inner handle of the door, and the occupant may close the door after getting off the vehicle. In such a case, when opening the door, the occupant has to use a door release mechanism for emergency. This operation takes time and effort. Thus, in such a case, by the release state maintaining mechanism, the operation member can be maintained at a state of releasing the door, and time and effort for using the door release mechanism for emergency from outside the vehicle, can be avoided. By providing, in the handle, the projection which is simple in structure, two functions of: restricting the movement amount of the operation member to the first position; and holding the operation member at the second position can be provided. Thus, the structure can be simplified and the number of parts can be reduced.

In the door handle stroke change structure of the embodiment of the present invention, the restriction member may have a fragile portion which is able to break when a predetermined force is applied to the operation member by a motion of moving the operation member from the first position to the second position.

According to the door stroke change structure of the embodiment of the present invention, the fragile portion is provided, which breaks by the predetermined force which is stronger than a normal force. Thus, at emergency, since there is a high possibility that the user will operate the operation member with a strong force due to panic, the restriction member breaks by the strong force, and hence the user can move the operation member to the second position and urgently release the door.

Obviously, numerous modifications and variations of the present invention are possible in light of the above teachings. It is therefore to be understood that within the scope of the appended claims, the invention may be practiced otherwise than as specifically described herein.

What is claimed is:

1. A door handle stroke change structure comprising:

a door to open and close a door opening of a vehicle;

a latch mechanism to cause the door to be retained relative to the vehicle in a closed position;

an electric latch drive mechanism to electrically cause the latch mechanism to perform an open action to allow the door to be opened from the closed position;

a mechanical latch drive mechanism to mechanically cause the latch mechanism to perform the open action; and an operation member provided in the door to operate the electric latch drive mechanism and the mechanical latch mechanism, the operation member being moveable to:

a closed position at which the latch mechanism is not caused to perform the open action, a first position at which the latch mechanism is caused to perform the open action by the electric latch drive mechanism, and a second position at which the latch mechanism is caused to perform the open action by the mechanical latch drive mechanism, wherein a motion by a user to move the operation member from the closed position to the first position is a same motion as a motion by the user to move the operation member from the closed position to the second position, and wherein a movement amount of the motion by the user to move the operation member from the closed position to the first position is greater than a movement amount of the motion by the user to move the operation member from the closed position to the second position.

2. The door handle stroke change structure according to claim 1, further comprising a restriction mechanism to restrict a movement of the operation member from the first position to the second position, the restriction mechanism comprising a release mechanism to release restriction of the movement of the operation member from the first position to the second position.

3. The door handle stroke change structure according to claim 2, further comprising a restriction member to restrict the movement of the operation member from the first position to the second position, the restriction member comprising a locking portion and having an elongated hole in which a rotation shaft provided in the door is inserted, wherein the operation member comprises a handle to rotate about the rotation shaft, wherein the restriction mechanism comprises the locking portion provided in the restriction member, and a first locked portion which is provided in the handle and locked with the locking portion in a rotation direction of the handle, wherein the release mechanism comprises the restriction member, wherein the restriction member is locked with the first locked portion of the handle when the rotation shaft is located at one end of the elongated hole in a longitudinal direction of the elongated hole, and wherein locking of the restriction member with the first locked portion of the handle is released when the rotation shaft is located at another end of the elongated hole in the longitudinal direction of the elongated hole.

4. The door handle stroke change structure according to claim 3, wherein the handle is urged by an urging member so as to return to the closed position, and wherein the restriction member is urged by the urging member so as to return to a position at which the locking portion of the restriction member is locked with the first locked portion of the handle.

5. The door handle stroke change structure according to claim 1, further comprising a release state maintaining mechanism to hold the operation member at the second position.

6. The door handle stroke change structure according to claim 3, wherein wherein the handle has a projection which projects in a radial direction of the rotation shaft, wherein the first locked portion is provided at one end of the projection in a rotation shaft direction of the handle, wherein the handle comprises a second locked portion at another end of the projection in the rotation shaft direction of the handle, the second locked portion being locked with the locking portion of the restriction member, and wherein the second locked portion is locked with the locking portion of the restriction member when the handle is located at the second position.

7. The door handle stroke change structure according to claim 3, wherein the restriction member comprises a fragile portion which is broken when a predetermined force is applied to the operation member due to a motion of moving the operation member from the first position to the second position.

8. The door handle stroke change structure according to claim 2, further comprising a release state maintaining mechanism to hold the operation member at the second position.

9. The door handle stroke change structure according to claim 3, further comprising a release state maintaining mechanism to hold the operation member at the second position.

10. The door handle stroke change structure according to claim 4, further comprising a release state maintaining mechanism to hold the operation member at the second position.

11. The door handle stroke change structure according to claim 4, wherein wherein the handle has a projection which projects in a radial direction of the rotation shaft, wherein the first locked portion is provided at one end of the projection in a rotation shaft direction of the handle, wherein the handle has a second locked portion at another end of the projection in the rotation shaft direction of the handle, the second locked portion being locked with the locking portion of the restriction member, and wherein the second locked portion is locked with the locking portion of the restriction member when the handle is located at the second position.

12. The door handle stroke change structure according to claim 4, wherein the restriction member comprises a fragile portion which is brokeable when a predetermined force is applied to the operation member due to a motion of moving the operation member from the first position to the second position.

13. The door handle stroke change structure according to claim 6, wherein the restriction member comprises a fragile portion which is brokeable when a predetermined force is applied to the operation member due to a motion of moving the operation member from the first position to the second position.

14. The door handle stroke change structure according to claim 9, wherein the restriction member comprises a fragile portion which is brokeable when a predetermined force is applied to the operation member due to a motion of moving the operation member from the first position to the second position.

15. The door handle stroke change structure according to claim 10, wherein the restriction member comprises a fragile portion which is brokeable when a predetermined force is applied to the operation member due to a motion of moving the operation member from the first position to the second position.

16. The door handle stroke change structure according to claim 11, wherein the restriction member comprises a fragile portion which is brokeable when a predetermined force is applied to the operation member due to a motion of moving the operation member from the first position to the second position.

* * * * *